United States Patent [19]
Klievoneit et al.
[11] 4,318,250
[45] Mar. 9, 1982

[54] WAFER GRINDER

[75] Inventors: Harold R. Klievoneit, Phoenix; Arthur A. Smith, Tucson, both of Ariz.

[73] Assignee: St. Florian Company, Ltd., Phoenix, Ariz.

[21] Appl. No.: 134,999

[22] Filed: Mar. 31, 1980

[51] Int. Cl.[3] ..... B24B 7/04
[52] U.S. Cl. ..... 51/134; 51/56 R; 51/118; 51/131.3; 51/327
[58] Field of Search ..... 51/110, 118, 128, 131.1, 51/131.3, 131.5, 134, 281 R, 327, 56 R, 165.77

[56] References Cited

U.S. PATENT DOCUMENTS 880,120 2/1908 Blessing ..... 51/110
1,263,057 4/1918 Griffin ..... 51/134
1,432,093 10/1922 Taylor ..... 51/131.3
1,917,504 7/1933 Curtis ..... 51/56
2,765,592 10/1956 Krug ..... 51/134
2,815,619 12/1957 Brownley ..... 51/56 X
3,225,493 12/1965 Kulbicki ..... 51/134

*Primary Examiner*—Harold D. Whitehead
*Attorney, Agent, or Firm*—Cahill, Sutton & Thomas

[57] ABSTRACT

A rotatable grinding wheel bears against a rotatable wafer disk support wheel to grind the wafer disks to a predetermined thickness. The grinding wheel is translatable laterally to its axis of rotation, which translation repositions the grinding wheel with respect to the support wheel in a fixed proportion to the lateral distance traveled and permits high tolerance grinding with relative coarse lateral positional adjustment of the grinding wheel.

8 Claims, 11 Drawing Figures

WAFER GRINDER

The present invention relates to grinders and, more particularly, to grinders for wafer disks.

In the electronics industry, and support industries therefor, segments of silicon wafer disks of various compositions form the nucleus of many electronic components. These disks are brittle and very fragile. Consequently, the minimum thickness to which they may be ground is dictated by the forces exerted by the grinding apparatus. Accordingly, the design and construction of attendant electronic components are limited by the apparatus employed in the fabrication of the silicon wafers.

Presently used apparatus for grinding silicon wafers includes positioning mechanisms for translating a grinding wheel along the axis of rotation by means of lead screws or the like. These lead screws, and equivalents thereof, have certain tolerance limitations which limit the thickness to which the wafer can be ground. That is, the inherent tolerance excursions present in such grinders requires that certain minimum wafer thickness limits be maintained to insure that the end products are commercially useable.

Moreover, because of the tolerance limitations inherent in presently used silicon wafer grinders, substantial waste results when specified thickness high tolerance silicon wafers must be ground for particular specialized electronic components as a large number will be either over or under ground.

It is therefore a primary object of the present invention to provide a high tolerance grinder for wafer disks.

Another object of the present invention is to provide a grinder having a grinding wheel positionable along a first axis to obtain a proportionate movement of the grinding wheel in a second axis.

Yet another object of the present invention is to provide a means for translating a rotating grinding wheel along the axis of rotation by translating the grinding wheel along a second axis.

A yet further object of the present invention is to provide a coarse positional adjustment of a grinding wheel in a first axis to obtain a fine positional adjustment of the grinding wheel in a second axis.

A further object of the present invention is to provide a grinder translatable along a first axis to obtain a proportionate movement in a second axis and toward the item being ground.

A still further object of the present invention is to provide a disk grinder having a supporting wheel supporting and collectively rotating a plurality of disks, which disks are ground by a grinding wheel repositionable toward the supporting wheel upon lateral movement of the grinding wheel across the supporting wheel.

A yet further object of the present invention is to provide a disk grinder capable of grinding silicon wafers to a very high tolerance.

These and other objects of the present invention will become apparent to those skilled in the art as the description thereof proceeds.

The present invention may be described with greater specificity and clarity with reference to the following drawings, in which.

Figure 1:
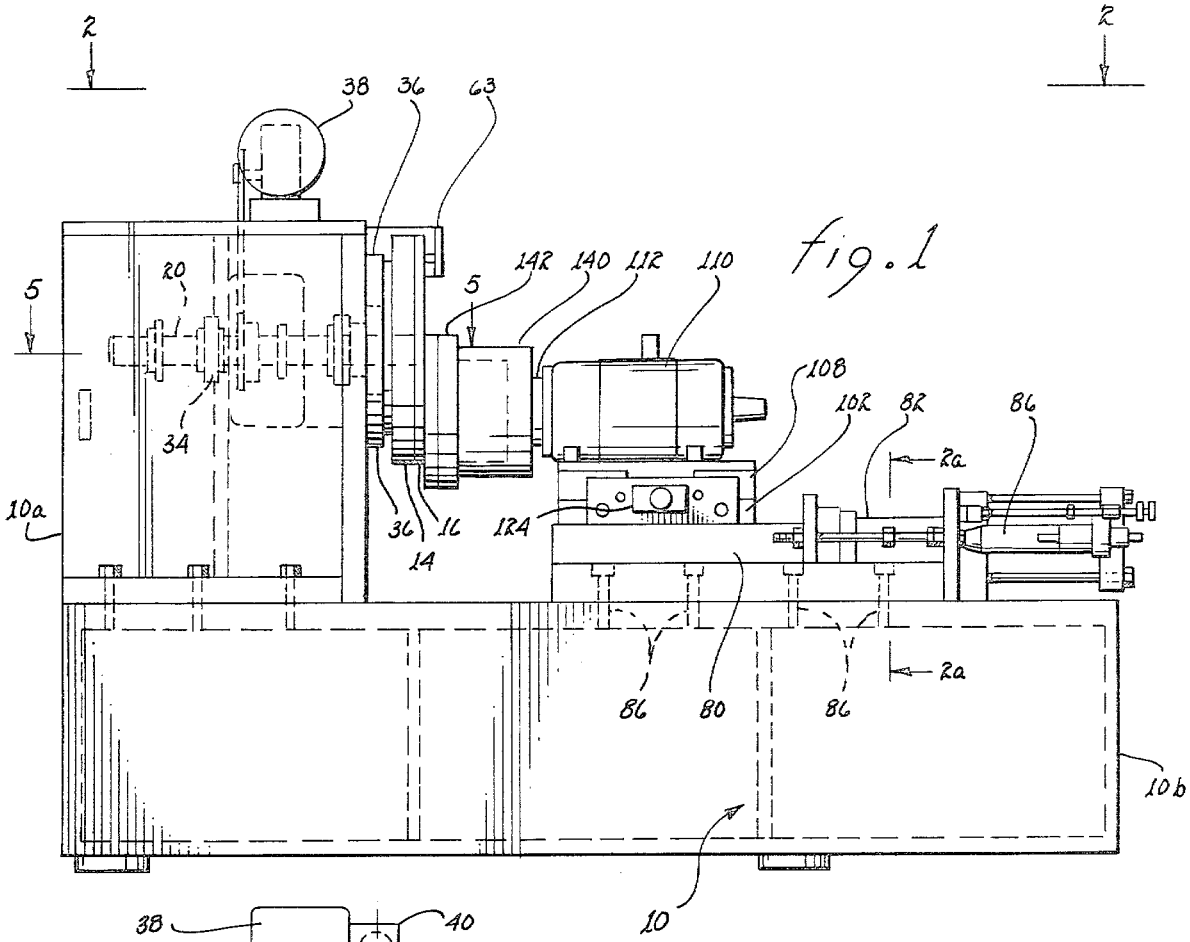
FIG. 1 is a side view of the disk grinder.
Figure 3:
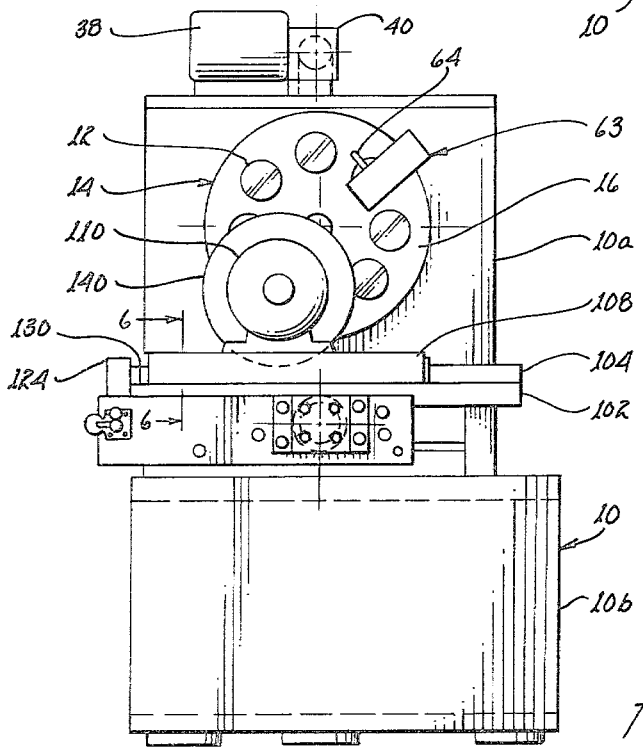
Figure 4:
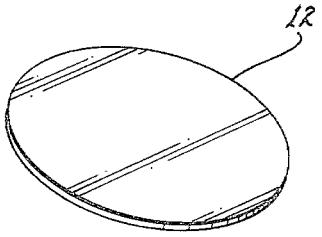
Figures 2, 2A:
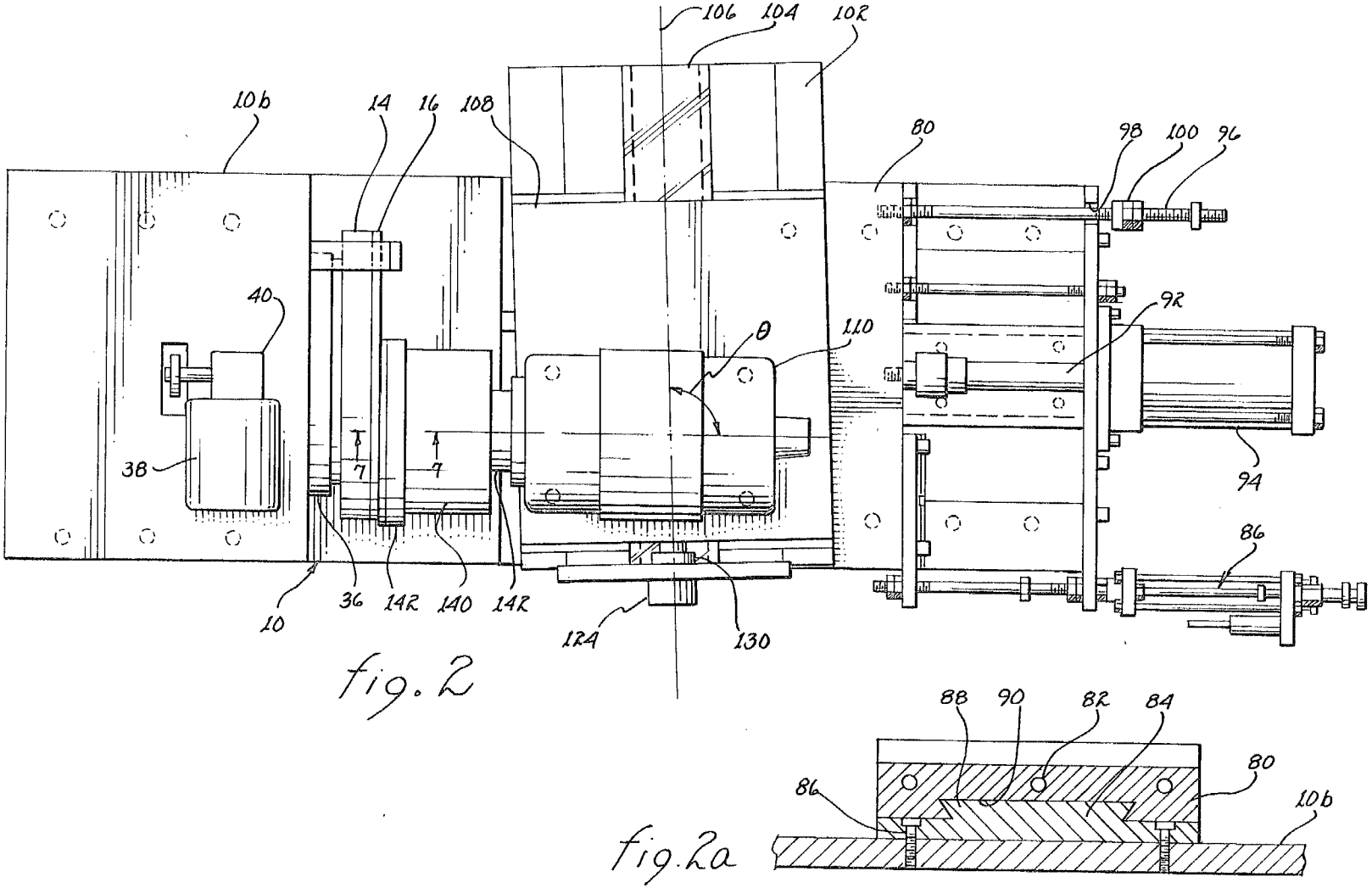
FIG. 2 is a top view taken along lines 2—2, as shown in FIG. 1.
Figure 8:
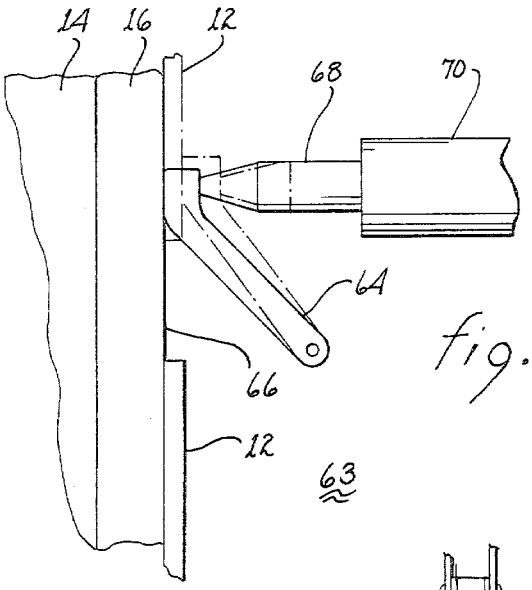
Figure 5:
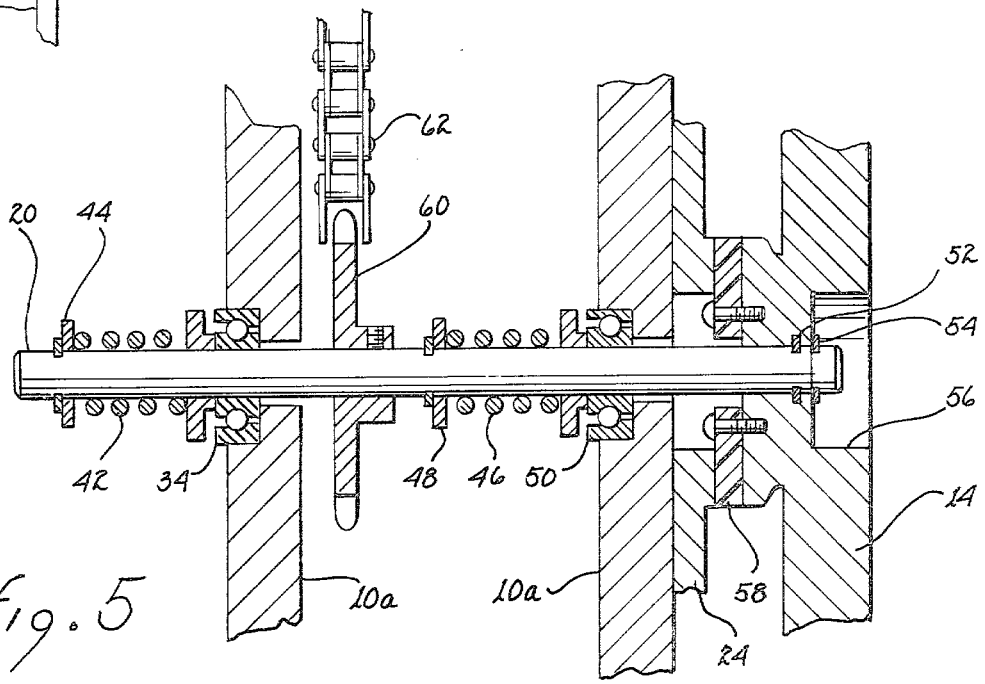
Figure 6:
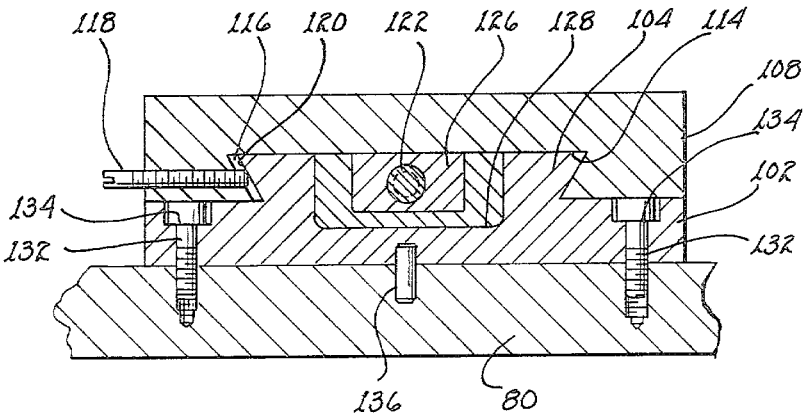
Figure 9:
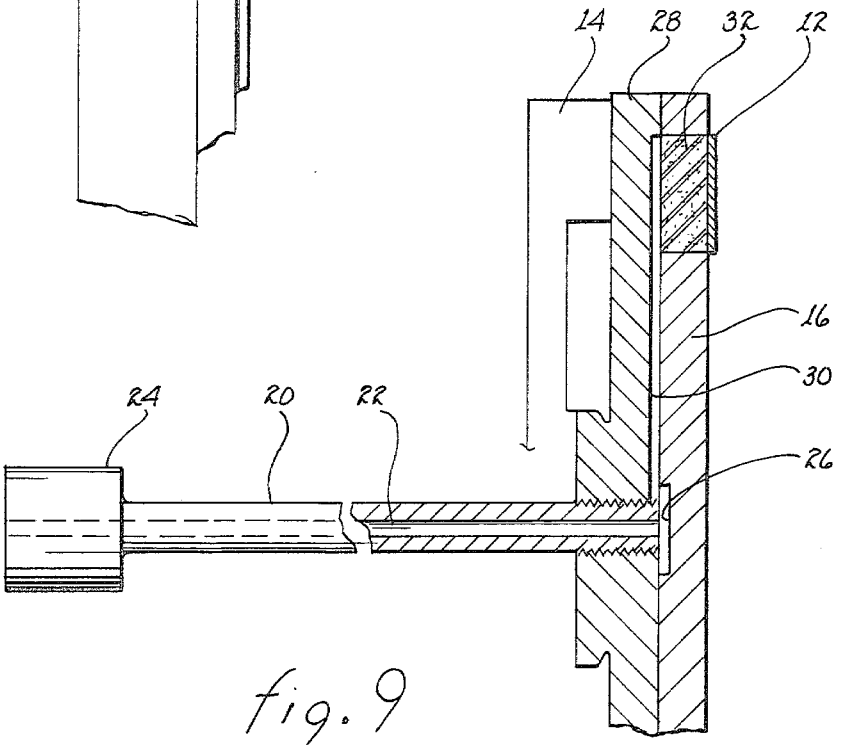
Figure 7:
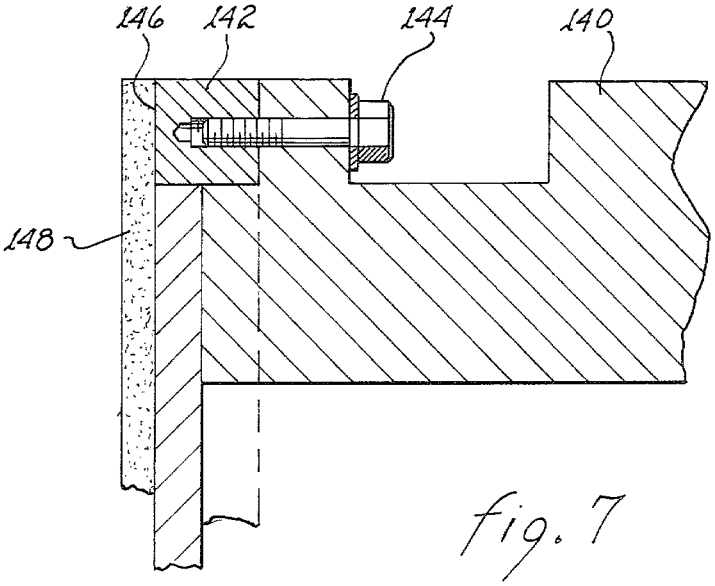

FIG. 2*a* is a partial cross-sectional view taken along lines 2*a*—2*a*, as shown in FIG. 1;

FIG. 3 is an end view;

FIG. 4 is a perspective view of a ground wafer;

FIG. 5 is a cross-sectional view taken along lines 5—5, as shown in FIG. 1;

FIG. 6 is a cross-sectional view taken along lines 6—6, as shown in FIG. 3;

FIG. 7 is a cross-sectional view taken along lines 7—7, as shown in FIG. 2;

FIG. 8 illustrates a wafer thickness measurement device;

FIG. 9 illustrates the attachment of the wafers; and

Figure 10:
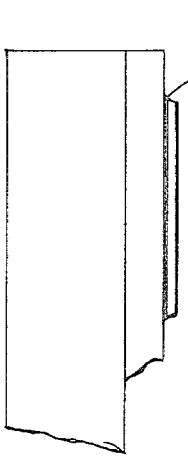

FIG. 10 illustrates another embodiment for attaching a wafer.

The apparatus and operating features of the disk grinder will be described with joint reference to FIGS. 1, 2 and 3. The operative elements are supported upon a robust and relatively massive L-shaped frame 10. This frame, as it positionally maintains the supported apparatus for the pieces to be ground and the grinding wheel relative to one another, must not be deformable in response to any pressures exerted by the grinding wheel or movement of the various moveable elements during the grinding process.

Work pieces 12, which may be disks such as silicon wafers as shown in FIG. 4, are ultimately supported upon a rotatable support wheel 14. The support wheel is relatively massive to provide a non-flexible, non-deformable support for the work pieces. A platen 16 is attached to the support wheel and serves as a mounting surface for the work pieces. Refering to FIG. 10, there is shown a means for mounting the work pieces upon the platen. Because the work pieces, when they are silicone wafers, are very fragile the mounting means must not require much force to effect removal of the work piece, yet the work pieces must be securely retained during grinding. Commercially available wax meets these requirements. Wax 18 is melted upon platen 16 at the appropriate locations and the work pieces are mounted thereon and become adhered thereto. This technique is well known to those skilled in the art. Moreover, various standard practice techniques may be employed to harden the wax and reduce the likelihood of inadvertent disengagement of the work pieces. After the work pieces have been ground, they may be removed by melting the wax. It may be noted that by maintaining adequate procedures for controlling the flow of the wax, it will not interfere with the grinding operation.

When wax is used to maintain the work pieces in place, it is prefered that the platen be readily removable to permit mounting and dismounting of the work pieces at a location apart from the grinder. Such mounting and dismounting can and may be accomplished by creating a plenum chamber(s) intermediate the support wheel and the platen and connecting the plenum chamber(s) to a source of vacuum (see in example FIG. 9). Thereby, the platen is held in place by vacuum. Mounting and dismounting of the platen then becomes simply a function of energizing and de-energizing the source of vacuum.

Alternatively, the platen may be bolted to the support wheel and the work pieces may be held in place by vacuum, as illustrated in FIGS. 1 and 9. A source of vacuum (not illustrated) is connected by a rotary coupling 24 to a pipe 22 extending through a hollow core of axel 20. The pipe is in fluid communication with a plenum chamber 26 disposed at the center of platen 16. A vacuum platen 28 is bolted to support wheel 14 and includes channels, such as channel 30, extending from a point in fluid communication with the plenum chamber to a point in proximity to the location of each work piece 12. At the work piece location, the channel is in direct communication with the work piece through ports or through a porous element 32. Variations of this structure are also contemplated. Thereby, the work pieces are readily mountable and dismountable and they will not be temporarily contaminated by wax or other adhesive.

Support wheel 14 is attached to an axel 20 extending into upper frame 20, as particularly shown in FIGS. 1, 2 and 3. A plurality of bearings such as bearing 34 and thrust bearing 36 accurately and precisely support the axel to prevent any wobble or misalignment of the support wheel about the axis of rotation. Power means, such as electric motor 38, is mounted upon upper frame 10a to rotatably drive axel 20 through power transmission means 40. As will be described in further detail below, various grinding loads imposed upon the support wheel through the work pieces are not necessarily in alignment with the axis of axel 20; accordingly, both the support wheel, the axel and the bearings supporting the axel must be sufficiently robust to withstand such loads without flexing or deforming of the surface supporting work pieces 12.

Referring specifically to FIG. 5, the details of the bearings and supports attendant axel 20 will be described. A spring preload is placed upon axel 20 through spring 42 disposed intermediate retaining ring 44 and bearing 34 anchored to a member of upper frame **10*a* and spring 46 disposed intermediate retaining ring 48 and bearing 50 disposed in another member of upper frame 10*a*. Support wheel 14 is pinned to axel 20 by pins 52 to prevent relative rotation therebetween and it is retained on the axel by retaining ring 54. A recess 56 within the support wheel accommodates the end of the axel to avoid protrusion of the axel into contact with platen 16. The pre-load draws support wheel 14 and attached bearing material 58, which may be of the low friction type sold under the mark "Teflon", against the back up plate of thrust bearing 24. With this arrangement, all backlash or play is removed. In this figure there is also shown a sprocket 60 and engaged chain 62 extending from a sprocket in transmission means 40 to transmit rotary motion to axel 20**.

Accurate grinding of the work piece is a primary attribute of the present invention. Such accuracy is regulated and maintained by a sensing device 63 shown in FIG. 8. A pivotally mounted sensing arm 64 rides upon surface 66 of platen 16 in an interfering relationship with each of the mounted work pieces 12. On engagement of the arm with a work piece the sensing arm will pivot, as shown in phantom lines, a number of degrees commensurate with the thickness of the work piece. The pivotal movement of the sensing arm is translated into rectilinear motion of a plunger 68 riding upon the sensing arm. The extent of rectilinear motion of the plunger is sensed by a detector 70. Through various circuitry, the detected motion is converted into a signal reflective of the actual thickness of the work piece. This signal is also employed to regulate the movement of the grinding wheel toward the work pieces. Thereby, the actual thickness is the criteria for stopping the grinding of the workpieces rather than some secondary information source based upon position of the grinding wheel and which source may be subject to accuracy variations because of wear, misalignment, cumulative tolerance variations and wear of the grit. The sensing device may be variously mounted and the mounting illustrated is representative thereof.

Referring to FIGS. 1, 2, **2*a* and 3, base 10*b* of frame 10 supports a positionable table 80. A bed 84 is attached to base 10*b* by a plurality of bolts 86. The bed includes a tenon 88 mating with a mortise 90 in table 80 to serve as a dovetail joint and guide for accurately regulating translation of the table with respect to the base. Well known means may be incorporated to maintain high tolerance conformance between the tenon and mortise and reduce slop therebetween. The table is positionable by translation of plunger 92 of pneumatic cylinder 94. Normally, the plunger of a pneumatic cylinder is very fast. Such speed is not needed nor desired for table 80. The advance and retraction of the table is controlled by a hydraulic cylinder and plunger unit 86, such as is sold under the mark "Hydrocheck". The unit includes a settable valve for regulating the amount of damping. The direction of movement of table 80 is parallel to the axis of axel 20 and perpendicular to the plane of support wheel 14. Various control means, not illustrated, are employable to actuate plunger 92 and position table 80 to an initial setting and retract the table. A threaded rod 96 extends through aperture 98 in base 10*b* into threaded engagement with table 80. A stop nut combination 100 limits the extent of penetration of the rod through the aperture and serves to locate the position of table 80 upon actuation of plunger 92**.

Table 80 supports a track assembly 102 having a tenon 104 of a dovetail joint aligned with the major axis of the track assembly. The major axis, identified by reference numeral 106 is set at an angle ($\theta$) with respect to the axis of translation of table 80 along base **10*b*. A platform 108 is translatably secured to track assembly 102 through a mortise to permit translation of the platform along axis 106, which translation is independent of any movement of track assembly 102 with respect to table 80**.

Power means, such as electric motor 110, is mounted upon platform 108 and oriented so as to align spindle 112 parallel with the axis of translation of table 80 and perpendicular to the plane of support wheel 14. Thus, the axis of spindle 112 is at an angle $\theta$ with respect to axis 106 of platform 108.

FIG. 6 illustrates the interface between platform 108 and track assembly 102. Relative movement between them is limited to one axis by the dove tail joint wherein tenon 104 of the track assembly extends into mortise 114 in the platform. Play of the dovetail joint is constrained by a nib 116 adjustably positioned by screw 118 to bear against sloping side 120 of the tenon. Drive screw 122, which may be turned by an electric motor 124, such as a stepper motor (see FIGS. 1, 2 and 3), or by a hand crank is in threaded engagement with flange 126 extending downwardly from platform 108 into channel 128 in the track assembly. As the drive screw is maintained longitudinally locked in place by bearing support 130, translation of the platform results upon rotation of the drive screw. Track assembly 102 is attached to table 80 by bolts 132 extending into the table from depressions 134. A locating pin 136 positionally mates the track assembly with the table in a predetermined relationship.

As shown in FIG. 7, spindle 112 supports a grinding head 140 of relatively massive proportions to serve as a robust base for grinding wheel body 142. The grinding wheel body is secured to the grinding head by several bolts 144 extending from the grinding head into threaded engagement with the grinding wheel body. Surface 146 of the grinding wheel body is planar, circular and normal to the longitudinal axis of spingle 112. Grit 148, in any of various physical embodiments, is attached to surface 146. As a result of the above described geometry with respect to the support wheel and the grinding head, surface 146 of the grinding wheel is parallel to surface 66 attendant support wheel 14; such parallelism is maintained by the robustness of frame 10 and the robustness of the various intermediate elements.

In a working embodiment of the present invention, axis 106 was set at an angle $\theta$ to define an angle of $91.2° \pm 0.1°$ With this angle, 50 units of movement of platform 108 and the supported grinding wheel along axis 106 produced one unit of movement of the platform and supported grinding wheel with respect to surface 66 of support wheel 14. It therefore becomes apparent that precise movement of the grinding head toward work pieces 12 is readily and accurately regulatable by stepper motor 124 or a hand crank. Thus, high tolerance grinding is easily achievable without danger of damage to the work pieces.

In operation, work pieces 12 are mounted upon surface 66 of platen 16 in a manner such as illustrated in FIG. 9 or 10. A grinding surface of grit 148 commensurate with the composition of the workpieces and of a fineness dependent upon the degree of surface finish desired, is mounted upon grinding wheel body 142. Table 80 is translated along its axis to bring the grinding surface into contact with or into proximity with work pieces 12. To begin grinding, electric motor 38 is energized to effect rotation of support wheel 14 and attached platen. Electric motor 110 is also energized to effect rotation of grinding head 140. As depicted in the figures, the grinding head overlaps only a portion of the support wheel whereby only one or a few of the work pieces are being ground at a time by the grit of the grinding wheel body. However, as the support wheel is rotating, all work pieces will be uniformly subjected to the grinding head on a repetitive basis.

The amount of material ground away on the work pieces is a function of the movement of the grinding head toward the support wheel while contact between the workpieces and grit of the grinding wheel body is maintained. The extent or degree of the incursion of the grinding surface into the work pieces is controlled and regulated by repositioning platform 108 along axis 106, which repositioning translates the grinding head toward the workpieces. By employing an angle for $\theta$, such as approximately 91.2°, very exacting control can be maintained of the extent of incursion of the grinding surface into the workpieces despite a relatively coarse positioning of platform 108 along axis 106 of track assembly 102. Thereby, powered or manual means for translating the platform along the track assembly need not be of extremely high precision tolerance components.

It is to be understood that access for mounting and dismounting work pieces 12 is readily achieved by positioning table 80 to the right. Such repositioning may be effected by energizing pneumatic cylinder 94 to retract plunger 92. Similarly, gross positioning of the grinding wheel head with respect to the work pieces on the support wheel is achieved by energization of the pneumatic cylinder 94 resulting in commensurate movement of plunger 92 and table 80 will be translated to the extent permitted by stop nut combination 100 engaging base **10*b***.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. Apparatus for precisely regulating and controlling the depth to which work pieces are ground by a grinding wheel by relocating the grinding wheel in one direction which relocation results in only a fractual movement of the grinding wheel in another direction toward the work pieces, said apparatus comprising in combination:

(a) a rotatable support wheel for supporting the work pieces in a plane perpendicular to the axis of rotation of said support wheel;

(b) a rotatable grinding wheel for grinding the work pieces, said grinding wheel having a working surface in a plane parallel to the work piece supporting plane of said support wheel and rotating about an axis parallel with the axis of said support wheel;

(c) means for repositioning said grinding wheel along a path fixed at an angle of other than 90° to the axis of rotation of said grinding wheel to draw said grinding wheel across the face of said support wheel to grind the work pieces supported thereon and to simultaneously relocate said grinding wheel toward or away from the work pieces depending upon the direction of travel along the path traversed by said grinding wheel;

whereby, the extent of movement of said grinding wheel toward or away from the work pieces is a function of the tangent of the path angle to provide a multiplied control and regulation grinding depth capability resolution.

2. The apparatus as set forth in claim 1 wherein the units of length traversed along the path by said grinding wheel in the one direction is fifty (50) for each unit of length traversed by said grinding wheel in the other direction.

3. The apparatus as set forth in claim 1 wherein the angle of the path is $91.2° \pm 0.1°$.

4. The apparatus as set forth in claim 1 wherein said grinding wheel comprises a grinding head, a grinding wheel body attached to said grinding head and grit mounted upon said grinding wheel body.

5. The apparatus as set forth in claim 4 including means for damping the travel of said grinding wheel along the path traversed.

6. A process for precisely regulating and controlling the depth to which work pieces are ground by a grinding wheel by relocating the grinding wheel in one direction which relocation results in only a fractional movement of the grinding wheel in another direction toward the work pieces, said process comprising the steps of:

(a) supporting the work pieces upon a support wheel in a plane perpendicular to the axis of rotation of the support wheel;

(b) grinding the work pieces with a grinding wheel rotating about an axis parallel to the axis of the support wheel, which grinding wheel has a working surface in a plane perpendicular to the work piece supporting plane of the support wheel;

(c) repositioning the grinding wheel along a path fixed at an angle of other than 90° to the axis of rotation of the grinding wheel to draw the grinding wheel across the face of the support wheel to grind the work pieces supported thereon and to simultaneously relocate the grinding wheel toward or away from the work pieces depending upon the direction of travel along the path traversed by the grinding wheel;

whereby, the movement of the grinding wheel toward or away from the work pieces is a function of the tangent of the path angle to provide a multiplied control and regulation grinding depth resolution capability.

7. The process as set forth in claim 6 wherein said step of repositioning includes the step of repositioning the grinding wheel at an angle of 91.2°±0.1°.

8. The process as set forth in claim 6 wherein said step of repositioning includes the step of repositioning the grinding wheel fifty (50) units of length in the one direction to obtain repositioning of the grinding wheel one (1) unit of length in the other direction.

* * * * *